US008291512B2

(12) United States Patent
Stoll

(10) Patent No.: US 8,291,512 B2
(45) Date of Patent: Oct. 23, 2012

(54) FACE SHIELD

(76) Inventor: Walter Stoll, Toledo, OH (US)

( * ) Notice: Subject to any disclaimer, the term of this patent is extended or adjusted under 35 U.S.C. 154(b) by 234 days.

(21) Appl. No.: 12/768,967

(22) Filed: Apr. 28, 2010

(65) Prior Publication Data

US 2011/0265236 A1 Nov. 3, 2011

(51) Int. Cl.
*A61F 9/00* (2006.01)

(52) U.S. Cl. ..... 2/15; 2/9; 2/410; 2/417; 2/418; 2/424

(58) Field of Classification Search ..... 2/9, 15, 2/417, 418, 422, 424, 171.4–171.8, 173, 2/206; 128/857, 858
See application file for complete search history.

(56) References Cited

U.S. PATENT DOCUMENTS 2,829,374 A * 4/1958 Malcom, Jr. ..... 2/9
2,881,443 A * 4/1959 Barker, Jr. ..... 2/9
3,120,002 A * 2/1964 Blumenthal ..... 2/9
3,214,767 A * 11/1965 Weber ..... 2/9
3,214,768 A * 11/1965 Bohner ..... 2/10
3,594,816 A 7/1971 Webb et al.
3,686,690 A * 8/1972 Webb ..... 2/9
3,763,495 A * 10/1973 De Angelis ..... 2/8.1
3,868,727 A * 3/1975 Paschall ..... 2/8.5
D254,638 S * 4/1980 Bay, Jr. ..... D29/109
4,495,657 A * 1/1985 Bay ..... 2/10
4,701,965 A * 10/1987 Landis ..... 2/428
4,843,643 A * 7/1989 Parissenti et al. ..... 2/13
4,850,049 A * 7/1989 Landis et al. ..... 2/10
4,852,185 A * 8/1989 Olson ..... 2/9
4,853,974 A 8/1989 Olim
4,864,653 A 9/1989 Landis
4,867,178 A 9/1989 Smith
4,884,296 A * 12/1989 Nix, Jr. ..... 2/11
4,920,576 A * 5/1990 Landis ..... 2/9
4,945,574 A * 8/1990 Dagher ..... 2/9
D320,869 S * 10/1991 Asbury et al. ..... D29/108
5,113,528 A 5/1992 Burke, Jr. et al.
5,138,714 A * 8/1992 Smith ..... 2/9
5,337,419 A 8/1994 Russell
5,365,615 A * 11/1994 Piszkin ..... 2/422
D361,160 S 8/1995 Russell
5,647,060 A 7/1997 Lee
5,673,431 A * 10/1997 Batty ..... 2/9
5,732,410 A * 3/1998 Machson ..... 2/9
5,765,223 A 6/1998 McCausland
5,970,514 A * 10/1999 Wang-Lee ..... 2/9
5,983,390 A 11/1999 Desy
6,016,808 A 1/2000 Landis
(Continued)

*Primary Examiner* — Khoa Huynh
*Assistant Examiner* — Andrew W Collins
(74) *Attorney, Agent, or Firm* — Fraser Clemens Martin & Miller LLC; Jacob M. Ward

(57) ABSTRACT

A face shield includes a brim having a front portion, a rear portion, an upper portion, and a lower portion. A channel is formed in the lower portion adjacent the rear portion of the brim. The front portion includes a plurality of spaced apart catch members disposed thereon. A head band is unitary with one side of the brim and configured to surround a head of a wearer. The head band has a free end that is adjustably insertable into the channel of the brim to select a size of the head band for the head of the wearer. The face shield may include a removable transparent shield having a plurality of holes formed therein. Each of the holes is configured to cooperate with one of the catch members of the brim to releasably hold the transparent shield on the front portion of the brim.

16 Claims, 6 Drawing Sheets

U.S. PATENT DOCUMENTS 6,375,865 B1 * 4/2002 Paulson et al. ..... 252/500
D457,987 S * 5/2002 Cheng ..... D29/122
6,457,180 B1 * 10/2002 Jung ..... 2/12
6,463,590 B1 * 10/2002 Dean et al. ..... 2/15
6,536,045 B1 * 3/2003 Wilson et al. ..... 2/15
6,996,846 B1 * 2/2006 Karapetyan ..... 2/9
7,490,359 B2 2/2009 Landis
7,725,949 B2 * 6/2010 Landis ..... 2/9
2002/0134390 A1 * 9/2002 Salatka et al. ..... 128/857
2007/0220649 A1 * 9/2007 Huh ..... 2/9

* cited by examiner

FACE SHIELD

FIELD OF THE INVENTION

The present disclosure relates to face shield and more particularly to a face shield with an adjustable head band.

BACKGROUND OF THE INVENTION

Safety is of the utmost concern in many occupations and sporting activities. In occupations and sporting activities where flying debris and fluids may contact an individual's face, a face shield is often used to protect the face of the individual wearing the face shield. A variety of known face shields are described in U.S. Pat. No. 3,594,816 to Webb et al., U.S. Pat. No. 4,853,974 to Olim, U.S. Pat. No. 4,864,653 to Landis, U.S. Pat. No. 4,867,178 to Smith, U.S. Pat. No. 5,113,528 to Burke, Jr. et al., U.S. Pat. No. 5,337,419 to Russell, U.S. Pat. No. 5,647,060 to Lee, U.S. Pat. No. 5,765,223 to McCausland, U.S. Pat. No. 5,983,390 to Desy, U.S. Pat. No. 6,016,808 to Landis, U.S. Pat. No. 7,490,359 to Landis, and U.S. Pat. No. D361,160 to Russell, the entire disclosures of which are hereby incorporated herein by reference.

U.S. Pat. No. 3,594,816 describes a face shield pivotally mounted upon a mounting band which is formed for snap fastening to snap fasteners found on conventional safety helmets. The shield has an integral latching tab for releasably latching the shield in a vertical position before the wearer's face.

U.S. Pat. No. 4,853,974 discloses a face protector having a flexible headband and a transparent flexible shield of sufficient size to protect the face of the wearer. The shield is sufficiently flexible and easily deformable to match the shape of the user's head. Fastener means carried by the headband and by the shield releasably fasten the band around the head of the wearer and also releasably fasten the shield to the headband. The fastener means are deformable to match the shape of the headband and to match the shape of the shield.

U.S. Pat. No. 4,864,653 shows a surgical style face mask which inhibits the passage of fluids between the periphery of the mask and the wearer's face while providing enhanced comfort to the wearer. A single pair of ties may be used to secure a mask to the head and face of the wearer. For other applications, a mask may be secured to the head and face of the wearer with a double pair of ties or four surgical tie strips. In other applications, a mask may be secured to the head and face of the wearer with a continuous loop of resilient material. Fluid impervious flaps are included to extend the coverage area of the face mask and improve the fluid seal between the periphery of the mask and the face of the wearer. The fluid impervious flaps also allow reducing the amount of filter media associated with each face mask while maintaining the same amount of effective filtration area and breathability.

In U.S. Pat. No. 4,867,178, a disposable face shield assembly is illustrated for the protection of the eyes and face of a wearer. The shield assembly includes an elongated, semi-flexible head support strip divided into four foldable segments. A rectangular, semi-flexible, transparent protective face panel is affixed at its upper edge portion to an intermediate face panel support segment of the head support strip.

U.S. Pat. No. 5,113,528 discloses a face shield for protecting a wearer's face from spatters. The shield includes a flexible, transparent portion sized to cover the face and a flexible spacer portion for contact with the wearer's forehead to provide adequate clearance of the transparent flexible portion away from the wearer's face. When worn, the flexible spacer portion substantially completely seals the top portion of the shield to prevent spatters from reaching the face from the top, that is, through the portion occupied by the spacer.

U.S. Pat. No. 5,337,419 shows a face protector for shielding the face of the wearer while permitting observation and pivoting of the shield toward and away from the face. The face protector includes an elongated flexible band of absorbent padding sized and adapted to be fitted about the head. Stiffening members are spaced apart and connected to the band when the band is fitted about the head. A flexible transparent face shield is connected to a stiffening member along its length.

U.S. Pat. No. 5,647,060 describes a face shield assembly to protect the wearer from contaminants and airborne particles. The shield assembly includes a visor having a head-engaging band and a forwardly extending bill portion which, in the preferred embodiment, defines a light passing area which in the preferred form comprises a plurality of apertures. The band carries attachment means in the form of outwardly extending studs which engage arcuate slots and apertures in the transparent shield. The transparent shield is fabricated from a flexible plastic and is spaced from the face of the wearer and extends above and below the visor for protection.

U.S. Pat. No. 5,765,223 discloses a face shield that includes a headband with an inner surface and an outer surface, first and second ends, and a visor between a portion of the inner and outer surfaces. The visor tapers from a maximum width at the midpoint between the first and second ends to a minimum at a first point spaced a distance from the first end and at a second point spaced a distance from the second end. A flexible fluid impervious transparent cover is removably attached to the outer edge of said headband. The flexible cover can be readily removed and replaced if damaged.

In U.S. Pat. No. 5,983,390, a disposable face shield having an attachment mechanism for securing a band to attach the shield to a user's face is disclosed. The disposable face shield includes a flexible transparent member having opposed slits therethrough. The slits are disposed on an upper portion of the transparent member. An elastic band having a width greater than a length of the slits is looped through the slits. The slits are arcuate which allows the ends of the band to be removably and adjustably disposed through the slits. A flexible forehead support member is provided on the upper portion of the transparent member to nestle the shield against a user's forehead.

U.S. Pat. No. 6,016,808 describes a visor-type face shield for dentists. The face shield includes a visor portion and a shield portion coupled to each other by a first pivotable connecting means and second pivotable connecting means. The visor portion includes a visor assembly having a visor member and a forehead member, a visor first extension, a visor second extension, and a band, which is coupled with the visor first extension and the visor second extension by the band first connection means and band second connection means, respectively.

U.S. Pat. No. 7,490,359 discloses a face shield which protects the face of the wearer from debris and/or hazardous materials. The face shield utilizes a two-piece tiered structure with a canted retention frame joined through an inclined structure member to a shield frame member, below which is retained a transparent shield, and above which a minishield. The shield frame member is retained forward of the retention frame member so as to retain the peripheral portions of the shield separated from the face of the user, providing improved ventilation and reduced fogging of the transparent shield.

U.S. Design Pat. No. D361,160 shows a face protector with pivoting face shield and stop.

There is a continuing need for a face shield for protecting a face of a wearer from flying debris and fluids. Desirably, the face shield may be used for both medical applications such as dentistry, and non-medical applications such as hazardous materials handling and sporting activities, and may be worn under conventional equipment such as hats and helmets.

SUMMARY OF THE INVENTION

In concordance with the instant disclosure, a face shield for protecting a face of a wearer from flying debris and fluids, which may be used for both medical applications such as dentistry, and non-medical applications such as hazardous materials handling and sporting activities, and which may be worn under conventional equipment such as hats and helmets, is surprisingly discovered.

In one embodiment, a face shield includes a brim having a front portion, a rear portion, an upper portion, and a lower portion. A channel is formed in the lower portion and disposed adjacent the rear portion of the brim. The front portion includes a plurality of catch members spaced apart and disposed thereon. An adjustable head band is permanently affixed to one side of the brim and configured to surround a head of a wearer. The head band has a free end that is insertable into the channel of the brim to select a size of the head band for the head of the wearer.

In another embodiment, a face shield includes a brim having a front portion, a rear portion, an upper portion, and a lower portion. The front portion includes a plurality of catch members spaced apart and disposed thereon. A channel is formed in the lower portion and disposed adjacent the rear portion of the brim. The brim has a pair of apertures in the upper portion. The apertures are separated by a central member extending from the front portion of the brim to the rear portion of the brim. An adjustable head band is permanently affixed to the brim and configured to surround a head of a wearer. The head band has a free end that is insertable into the channel of the brim for the wearer to select a size of the head band. The face shield further includes a removable first transparent shield having a plurality of holes formed therein. Each of the holes cooperates with one of the catch members of the brim to releasably hold the first transparent shield on the front portion of the brim.

In a further embodiment, a face shield includes a brim having a front portion, a rear portion, an upper portion, and a lower portion. The front portion includes a plurality of catch members spaced apart and disposed thereon. At least one of the catch members is substantially hook-shaped, and another of the catch members is flexible. The flexible catch member includes a pair of spaced apart prongs. One of the prongs has a portion angled toward the front portion of the brim. The lower portion has a channel formed therein and disposed adjacent the rear portion of the brim. The brim has a pair of apertures in the upper portion. The apertures are separated by a central member extending from the front portion of the brim to the rear portion of the brim. The brim and the head band are one-piece and integrally formed. An adjustable head band is permanently affixed to the brim and configured to surround a head of a wearer. The head band has a free end that is insertable into the channel of the brim for the wearer to select a size of the head band. The head band includes a plurality of protuberances formed thereon. The channel has at least one projecting member formed therein. The projecting member is configured to rest between a pair of the protuberances on the adjustable head band and mechanically holds the head band at the selected size. The brim includes a pair of tabs extend downwardly from the channel. The projecting member is also formed on one of the tabs. Each of the tabs has a hole formed therein. A retaining member is disposed through the holes in the tabs to militate against the free end of the head band sliding downwardly out of the channel. The face shield further includes a removable first transparent shield having a plurality of holes formed therein. Each of the holes cooperates with one of the catch members of the brim to releasably hold the first transparent shield on the front portion of the brim. The face shield also includes a removable second transparent shield. The second transparent shield is disposed over the central member and bent downwardly at the ends of the second transparent shield to cooperate with edges of the apertures and hold the second transparent shield in place. The central member is also designed to be a grasping point for the user to remove and place the face shield with one hand, while maintaining a repeatable touch zone on the brim, thereby eliminating the need for the user to reglove.

DRAWINGS

The above, as well as other advantages of the present disclosure, will become readily apparent to those skilled in the art from the following detailed description, particularly when considered in the light of the drawings described herein.

DETAILED DESCRIPTION OF THE INVENTION

Figure 1:
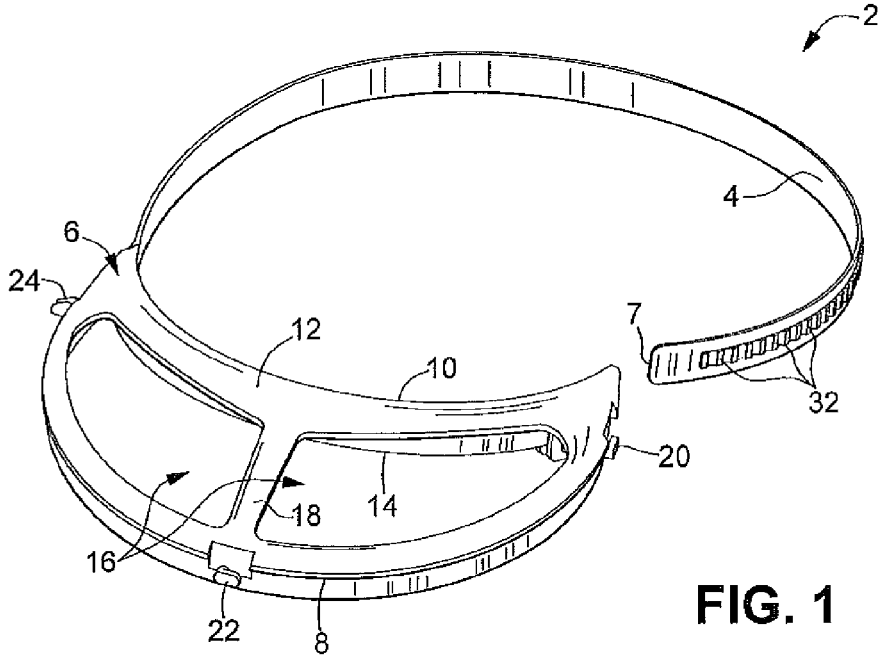
FIG. 1 is a top perspective view of a face shield, shown in an unclasped position.

The following detailed description and appended drawings describe and illustrate various embodiments of the invention. The description and drawings serve to enable one skilled in the art to make and use the invention, and are not intended to limit the scope of the invention in any manner.

As shown in FIGS. 1-13, the invention is a face shield 2. The face shield 2 is useful for both medical applications such as surgery and dentistry, and non-medical applications such as hazardous materials handling and sporting activities.

The face shield 2 includes an adjustable head band 4 that is integrally formed with a brim 6. The adjustable head band 4 is permanently affixed to one side of the brim 6 and has a free end 7. Advantageously, the adjustable head band 4 and the brim 6 are integrally formed to provide the face shield 2 as one-piece. The adjustable head band 4 and the brim 6 may be injection molded, for example, from polypropylene. In other embodiments, polycarbonate may be used. One of ordinary skill in the art should understand that other suitable fabrication methods and materials may also be employed to form the one-piece face shield 2 of the present disclosure.

The brim 6 has a front portion 8, a rear portion 10, an upper portion 12, and a lower portion 14. The brim 6 has a pair of apertures 16 formed in the upper portion 12. The apertures 16 are separated by a central member 18 extending from the front portion 8 of the brim 6 to the rear portion 10 of the brim 6. A support member 19 may be disposed beneath the central member 18 and between the front portion 8 and the rear portion 10 to stabilize the brim 6.

The front portion 8 of the brim 6 has a plurality of catch members 20, 22, 24 formed thereon. In the particular embodiment shown in FIGS. 1-13, the front portion 8 of the brim 6 includes at least three catch members 20, 22, 24. The catch members 20 permit a first transparent shield 26, also called a visor, to be disposed on the front portion 8 of the brim 6.

Figure 12:
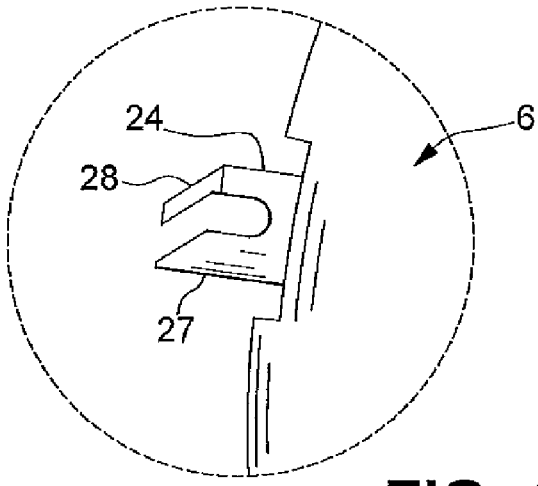
FIG. 12 is an enlarged fragmentary top plan view of the face shield taken in circle 12 of FIG. 5.

The plurality of catch members 20, 22, 24 may include a first catch member 20, a second catch member 22, and a third catch member 24. The first and second catch members 20, 22 are substantially hook-shaped. The third catch member 26 is flexible. As shown in FIG. 12, the flexible third catch member 26 has a pair of prongs 27, 28 with a slot formed therebetween. One of the prongs 28 is angled toward the front portion 8 of the brim 6 that permits the first transparent shield 26 to be slid thereover. The angled one of the prongs 28 bends or deflects slightly to facilitate the sliding of the first transparent shield 26 thereover. The prong 28 facilitates a tightening of the first transparent shield 26 due to the flexible nature and angled surface. The prong 27 limits a movement of the prong 28 during a loading of the first transparent shield 26, and thereby militates against breakage of the prong 28.

The catch members 20, 22, 24 are received in holes (not shown) formed in the first transparent shield 26. The holes may be substantially oval-shaped. The pronged catch member 24 may have an oval-shaped cross-section to stabilize the transparent shield 26 during and after insertion of the transparent shield 26 on the brim 6. The first catch member 20 and the second catch member 22 may also have an oval-shaped cross-section. The catch members 20, 22, 24 permit the first transparent shield 26 to be extended across the front portion 8 of the brim 6 and removably held to the brim 6. When the first transparent shield 26 is removed after use, a different first transparent shield 26 may be stretched over the front portion 8 of the brim 6. The stretching of the first transparent shield 26 over the brim 6 advantageously contributes to a rigidity of the thin first transparent shield 26. The first transparent shield 26 is thereby replaceable.

The first transparent shield 26 has a thickness suitable for the first transparent shield 26 to be extended across the front portion 8 of the brim 6, while also providing a rigidity to the first transparent shield 26 sufficient to protect the face of the wearer from flying debris and fluids. It should be appreciated that the first transparent shield 26 is disposable. The first transparent shield 26 has a thickness from about 5 mil (0.005 inches) to about 15 mil (0.015 inches). In a particular embodiment, the first transparent shield 26 has the thickness of about 5 mil (0.005 inches). As a nonlimiting example, the first transparent shield 26 may have a weight of about 7 grams. Due in part to the thin design of the face shield 2 including the head band 4, the brim 6, and the first transparent shield 26 is likewise very light. It should be appreciated that the light weight of the assembled face shield 2 contributes to a long-term comfort for the wearer of the face shield 2. In certain embodiments, the assembled face shield 2 has a weight of about one (1) ounce, or roughly 30 grams. In other embodiments, such as where the face shield 2 is used for certain industrial and sport applications, the thickness of the first transparent shield 26 may be about 15 mil (0.015 inches). The first transparent shield 26 may be formed from any material having sufficient transparency and flexibility to be extended across the front portion 8 of the brim 6. As a nonlimiting example, the first transparent shield 26 is formed from polyester. Other thicknesses, weights, and materials may also be employed. The first transparent shield 26 may also be colored, as desired.

The first transparent shield 26 extends downwardly from the brim 6 and protects the face of the wearer from debris traveling toward the wearer's face. The first transparent shield 26 may be substantially rectangular in shape when disposed on a planar surface. In a particular embodiment, the first transparent shield extends downwardly about seven inches (7") from the brim 6 to cover an entirety of the wearer's face. In other embodiments, the first transparent shield 26 extends downwardly about four inches (4") from the brim 6 to cover the wearer's eyes. A skilled artisan should appreciate that other lengths and shapes of the first transparent shield 26 may also be employed within the scope of the present disclosure.

As illustrated in FIGS. 3, 4, 6, 11, and 13, the brim 6 has a channel 30 formed in the lower portion 14 thereof. The channel 30 extends along the lower portion 14 of the brim 6 and adjacent the rear portion 10 of the brim 6. The free end 7 of the adjustable head band 4 is received by the channel 30 to form a ring to wrap around the head of the wearer. The adjustable head band 4 has a plurality of protuberances 32 formed thereon. The protuberances 32 may be substantially evenly spaced apart from one another on the adjustable head band 4.

Figure 11:
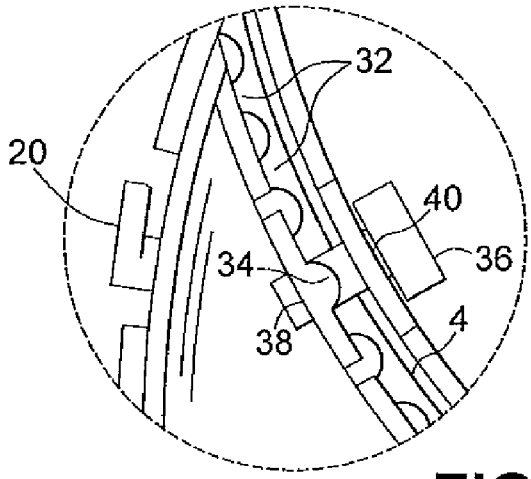
FIG. 11 is an enlarged fragmentary bottom plan view of the face shield taken in circle 11 of FIG. 4.
Figure 13:
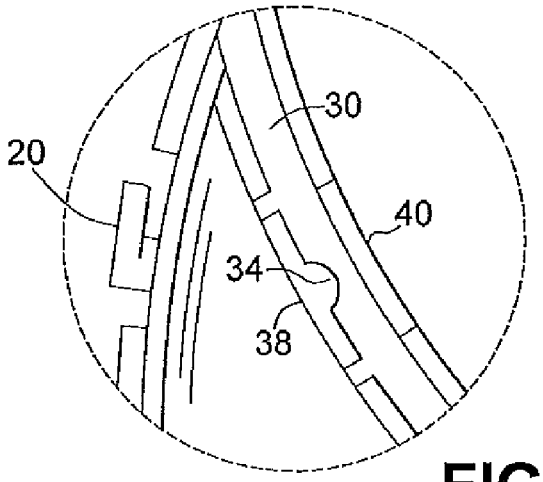
FIG. 13 is an enlarged fragmentary bottom plan view of the face shield taken in circle 13 of FIG. 6.

With reference to FIGS. 11 and 13, the channel 30 has a projecting member 34 disposed in the channel 30. The projecting member 34 permits the adjustable head band 4 to slide thereover when the adjustable head band 4 is inserted into the channel 30. The projecting member 34 rests between a pair of the protuberances 32 on the adjustable head band 4. The projecting member 34 thereby mechanically holds the adjustable head band 4 at a desired head size, for example, to match a size of the face shield 2 to the head of the wearer. In the embodiment shown, the projecting member 34 extends along a depth of the channel 30. The projecting member 34 may be Quonset-like and have a semicircular cross-sectional shape. Other lengths and cross-sectional shapes for the projecting member 34 are also within the scope of the present disclosure.

Figure 4:
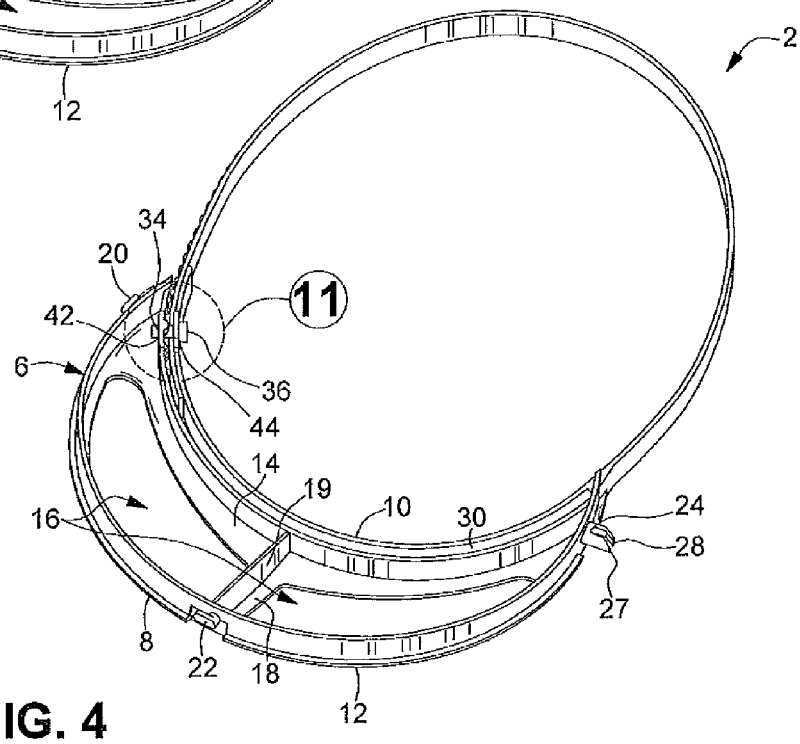
FIG. 4 is a bottom perspective view of the face shield shown in FIG. 2 with the first shield and the second shield removed.
Figure 5:
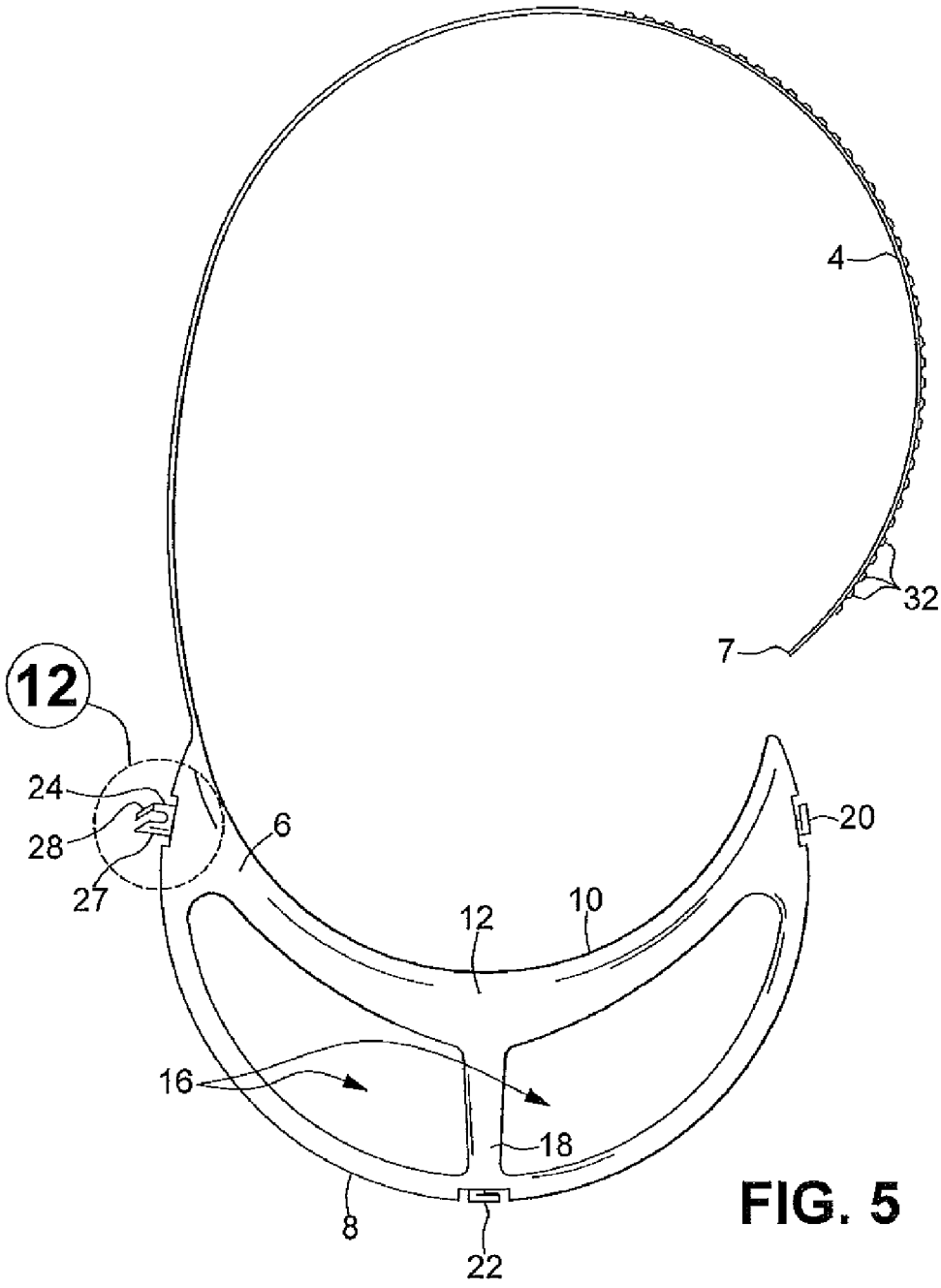
FIG. 5 is a top plan view of the face shield shown in FIG. 1.
Figure 6:
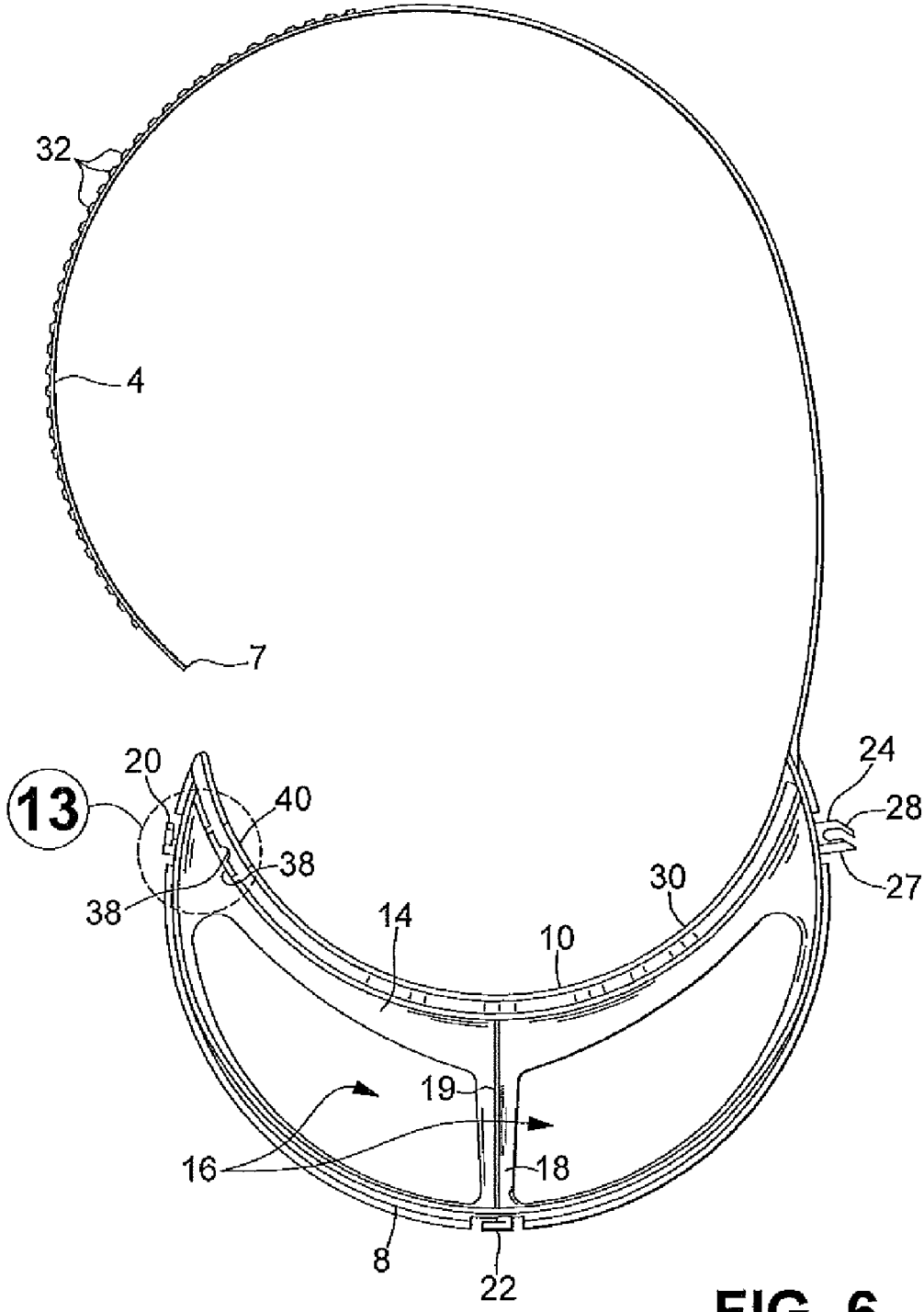
FIG. 6 is a bottom plan view of the face shield shown in FIG. 1.
Figure 7:
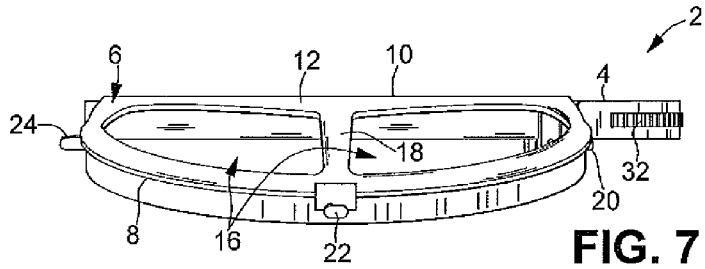
FIG. 7 is a front elevational view of the face shield shown in FIG. 1.
Figure 8:
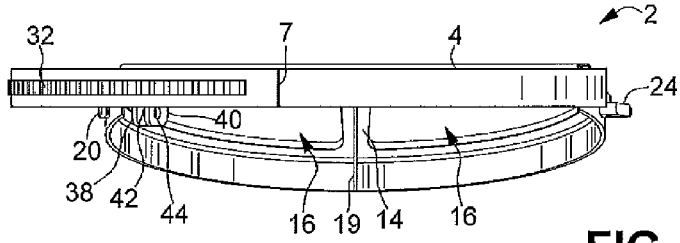
FIG. 8 is a rear elevational view of the face shield shown in FIG. 1.
Figure 9:
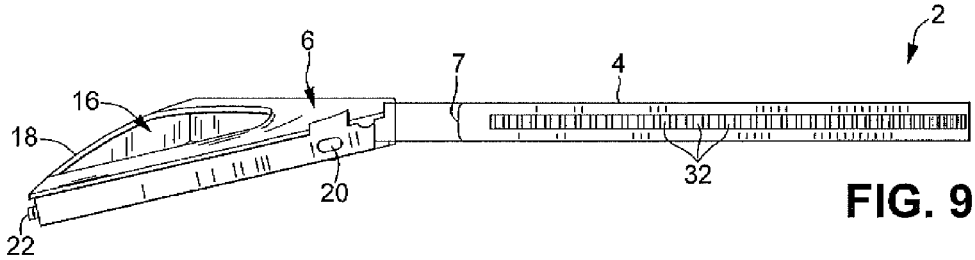
FIG. 9 is a left side elevational view of the face shield shown in FIG. 1.
Figure 10:
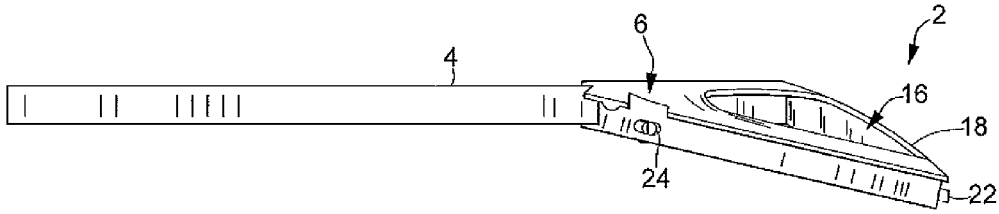
FIG. 10 is a right side elevational view of the face shield shown in FIG. 1.

A retaining member 36 may be disposed across the channel 30, for example, as shown in FIGS. 4 and 11. As a nonlimiting example, the retaining member 36 may be a plug-in fastener or rivet disposed through the walls of the channel 30 above the adjustable head band 4. In a particular embodiment, the retaining member 36 is a slotted and tapered push-in fastener. The retaining member 36 is configured to keep the adjustable head band 4 from sliding downwardly out of the channel 30 when the free end 7 of the adjustable head band 4 is inserted therein. In particular, the retaining member 36 is configured to keep the adjustable head band 4 from sliding out when the face shield 2 is being worn.

In certain embodiments, a pair of tabs 38, 40 may extend downwardly from the channel 30. The tabs 38, 40 may extend downwardly from, and be integral with, walls forming the channel on the lower portion 14 of the brim 6. The projecting member 34 may be formed on one of the tabs 38, 40. In one embodiment, each of the tabs 38, 40 has a hole 42, 44 formed therein. The retaining member 36 may be disposed through the holes 42, 44 formed in the tabs 38, 40 to thereby militate against the free end 7 of the head band 4 sliding downwardly out of the channel 30.

Figure 2:
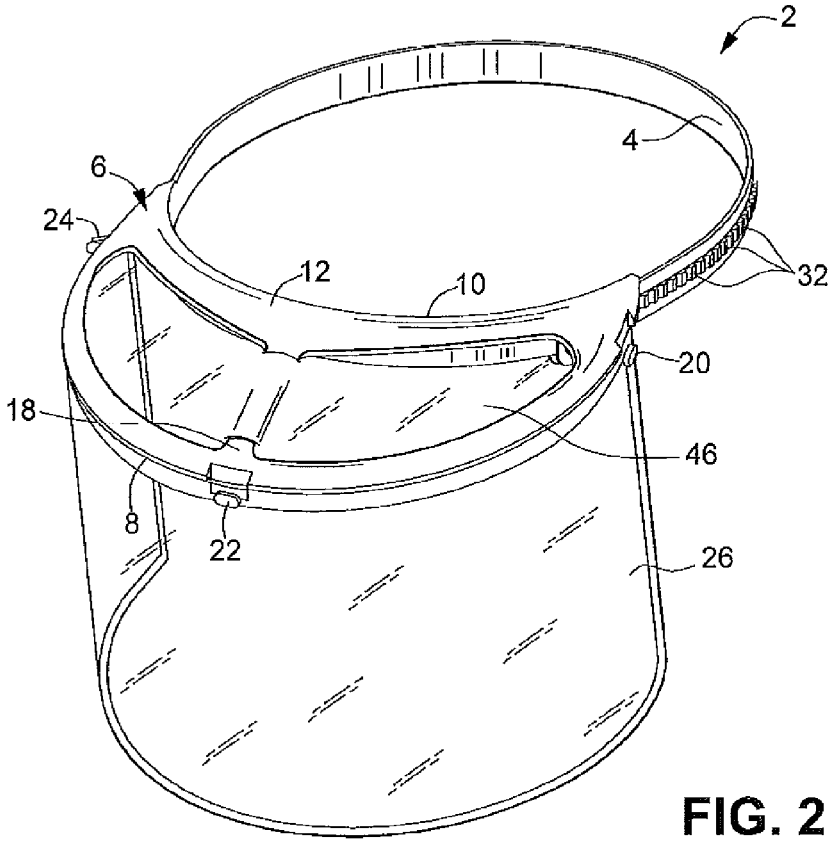
FIG. 2 is a top perspective view of the face shield of FIG. 1, shown in a clasped position with a first removable transparent shield and a second removable transparent shield disposed thereon.
Figure 3:
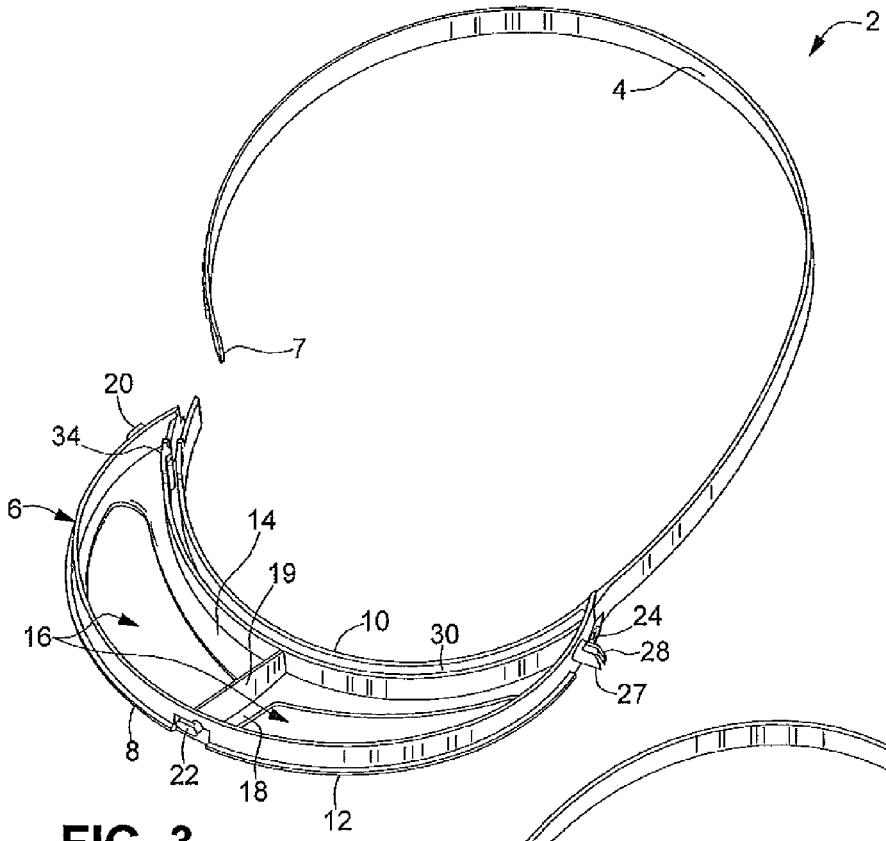
FIG. 3 is a bottom perspective view of the face shield shown in FIG. 1.

With renewed reference to FIG. 2, a second transparent shield 46 may be inserted across the brim 6 to cover both of the apertures 16. For example, the second transparent shield 46 may be disposed over the central member 18 and be bent downwardly at the ends thereof to cooperate with edges of the brim forming the apertures 16 to hold the second transparent shield 46 in place. The second transparent shield 46 protects a wearer of the face shield 2 from debris falling from above the brim 6. Like the first transparent shield 26, the second transparent shield is disposable. In a particular embodiment, the second transparent shield 46 is up to about 15 mil (0.015 inches) in thickness and formed from polycarbonate. As a nonlimiting example, the second transparent shield 46 may have a weight of about 5 grams. Other thicknesses, weights, and materials may also be employed for the second transparent shield 46, as desired.

In other embodiments, the face shield 2 includes a foam member (not shown) disposed on the rear portion 10 of the brim 6. The foam member is configured to provide a desired level of comfort to the wearer of the face shield 2. The foam member may include a strip of foam having an adhesive backing. The adhesive backing allows the foam member to be readily replaceable. The foam member may be formed from a closed cell polyurethane foam material, although one of ordinary skill in the art should appreciate that other foam materials may also be used within the scope of the present disclosure.

Advantageously, the face shield 2 of the present disclosure protects the face of the wearer from flying or airborne debris and fluids. The individual first and second transparent shields 26, 46 are readily replaceable, and may be disposed of following their use. It has been found that the first and second transparent shields 26, 46 may be replaced more quickly than other shields that are presently commercially available. The face shield 2 provides a high degree of comfort to the user due to the custom no-pressure fit, and due to the low weight of the assembled face shield 2 including the head band 4, the brim 6, and the first transparent shield 26. Additionally, due to the one-piece injection molded design of the head band 4 and the brim 6, the face shield 2 is inexpensive to manufacture and can be provided at a relatively low cost to the user. The face shield 2 is particularly suitable for medical applications such as surgery and dentistry, and non-medical applications such as hazardous materials handling and sporting activities. It should be appreciated that the face shield 2 may be worn under conventional equipment such as hats and helmets, making it particularly useful for a sporting activity such as cycling and the like.

While certain representative embodiments and details have been shown for purposes of illustrating the invention, it will be apparent to those skilled in the art that various changes may be made without departing from the scope of the disclosure, which is further described in the following appended claims.

What is claimed is:

1. A face shield comprising:

a brim having a front portion, a rear portion, an upper portion, and a lower portion, the front portion including a plurality of spaced apart catch members disposed thereon, the brim including a channel formed in the lower portion adjacent the rear portion; and a head band unitary with the brim and configured to surround a head of a wearer, the head band having a free end that is adjustably insertable into the channel of the brim to select a size of the head band, wherein the head band includes a plurality of protuberances formed thereon, and the channel includes at least one projecting member formed therein, the projecting member configured to cooperate with the protuberances on the adjustable head band to retain the head band at the size selected, a pair of tabs extending downwardly from walls forming the channel.

2. The face shield of claim 1, wherein the brim and the head band are one-piece and integrally formed.

3. The face shield of claim 1, wherein at least one of the catch members is substantially hook-shaped, and another of the catch members is flexible.

4. The face shield of claim 3, wherein the flexible catch member includes a pair of spaced apart prongs, one of the prongs having a portion angled toward the front portion of the brim, the angled prong flexible to permit a removable shield to be slid thereover.

5. The face shield of claim 1, wherein the projecting member is formed on one of the tabs.

6. The face shield of claim 5, wherein each of the tabs includes a hole formed therein.

7. The face shield of claim 6, further comprising a retaining member disposed through the holes in the tabs to militate against the free end of the head band sliding downwardly out of the channel.

8. The face shield of claim 7, wherein the retaining member is a slotted and tapered push-in fastener disposed through the holes in the tabs.

9. The face shield of claim 1, further comprising a removable transparent shield having a plurality of holes formed therein, each of the holes cooperating with one of the catch members of the brim to releasably hold the transparent shield on the front portion of the brim.

10. The face shield of claim 9, wherein the first transparent shield has a thickness from 5 mil to 15 mil.

11. The face shield of claim 9, wherein the transparent shield is formed from one of polyester and polycarbonate.

12. A face shield comprising:

a brim having a front portion, a rear portion, an upper portion, and a lower portion, the front portion including a plurality of spaced apart catch members disposed thereon, the brim including a channel formed in the lower portion adjacent the rear portion, wherein the brim has a pair of apertures formed in the upper portion, the apertures separated by a central member extending from the front portion of the brim to the rear portion of the brim;

a head band unitary with the brim and configured to surround a head of a wearer, the head band having a free end that is adjustably insertable into the channel of the brim to select a size of the head band; and a removable transparent shield, the transparent shield disposed over the central member and bent downwardly at the ends of the transparent shield to cooperate with edges of the brim forming the apertures to hold the transparent shield in place.

13. The face shield of claim 12, wherein the transparent shield has a thickness of up to 15 mil.

14. The face shield of claim 12, wherein the transparent shield is formed from polycarbonate.

15. The face shield of claim 1, wherein the brim includes a support member disposed beneath the upper portion of the brim between the front portion and the rear portion of the brim to stabilize the brim.

16. A face shield comprising:

a brim having a front portion, a rear portion, an upper portion, and a lower portion, the front portion including a plurality of spaced apart catch members disposed thereon, at least one of the catch members being substantially hook-shaped, and another of the catch member being a flexible member, the flexible member including a pair of spaced apart prongs, one of the prongs having a portion angled toward the front portion of the brim, the lower portion of the brim including a channel formed therein adjacent the rear portion, the brim having a pair of apertures in the upper portion, the apertures separated by a central member extending from the front portion of the brim to the rear portion of the brim, wherein the brim and the head band are one-piece and integrally formed;

a head band unitary with the brim and configured to surround a head of a wearer, the head band having a free end that is adjustably insertable into the channel of the brim to select a size of the head band, the head band including a plurality of protuberances formed thereon, the channel having at least one projecting member formed therein, the projecting member configured to rest between a pair of the protuberances on the adjustable head band to mechanically hold the head band at the selected size, the brim including a pair of tabs extend downwardly from the channel, the projecting member formed on one of the tabs, and each of the tabs having a hole formed therein;

a retaining member disposed through the holes in the tabs to militate against the free end of the head band sliding downwardly out of the channel;

a removable first transparent shield having a plurality of holes formed therein, each of the holes cooperating with one of the catch members of the brim to releasably hold the first transparent shield on the front portion of the brim; and a removable second transparent shield, the second transparent shield disposed over the central member and bent downwardly at the ends of the second transparent shield to cooperate with edges of the apertures to hold the second transparent shield in place.

* * * * *